US005975083A

United States Patent [19]

Henderson, Jr.

[11] Patent Number: 5,975,083

[45] Date of Patent: Nov. 2, 1999

[54] SANITARY HAND BARRIER

[76] Inventor: Ralph E. Henderson, Jr., 2870 Keaser Cir. East, Germantown, Tenn. 38139-6827

[21] Appl. No.: 09/132,392

[22] Filed: Apr. 29, 1998

[51] Int. Cl.[6] ..... A61F 5/37

[52] U.S. Cl. ..... 128/878; 128/879

[58] Field of Search ..... 128/877, 878, 128/879; 602/20–21; 2/159, 163, 167

[56] References Cited

U.S. PATENT DOCUMENTS

| | | | |
|---|---|---|---|
| 3,229,875 | 1/1966 | Stoller | 225/38 |
| 3,920,500 | 11/1975 | Brieske | 156/251 |
| 4,034,853 | 7/1977 | Smith | 206/278 |
| 4,677,697 | 7/1987 | Hayes | 2/159 |
| 4,916,757 | 4/1990 | Berlin et al. | 2/159 |
| 4,928,322 | 5/1990 | Bradfield | 2/169 |
| 5,025,503 | 6/1991 | O'Brien | 2/163 |
| 5,636,406 | 6/1997 | Strong | 15/227 |

*Primary Examiner*—Michael A. Brown
*Attorney, Agent, or Firm*—Garvey, Smith, Nehrbass & Doody, L.L.C.

[57] ABSTRACT

A method and apparatus for providing a sanitary barrier for a user's hand comprises the steps of providing a supply of segments of polymeric film on an elongated roll, preferably housed in a dispenser, each segment having a surface that enables the segment to adhere to a user's hand when the user places his or her hand against the surface. The dispenser can provide a backing place for holding the free end of the roll so that when the user applied pressure to the free end of the roll at the segment to be dispensed, the user's hand presses against the film segment and the underlying backing plate.

In the method, the segments are separated one from the next with a serration. The film tears at the serration when a user withdraws his or her hand away from the area occupied by the supply roll so that the adhesion between the film and the user's hand is able to overcome the tensile strength of the roll at the serration.

12 Claims, 3 Drawing Sheets

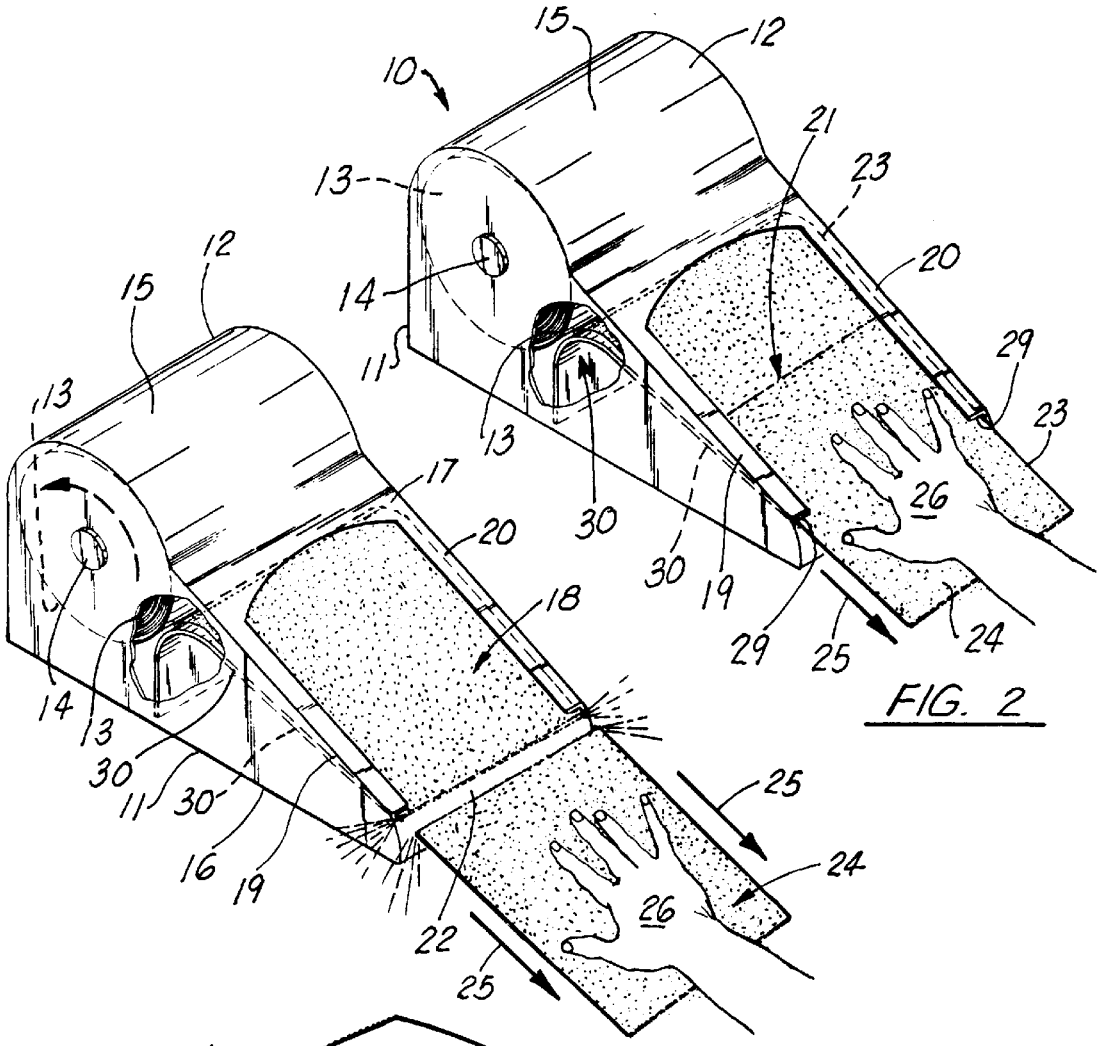
FIG. 2
FIG. 3
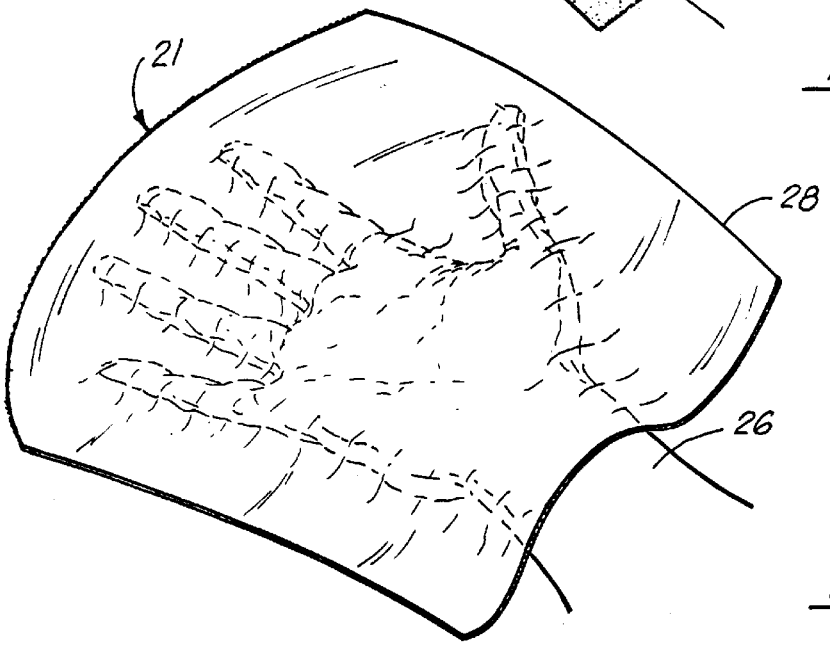
FIG. 4

SANITARY HAND BARRIER

BACKGROUND OF THE INVENTION

1. Field of the Invention

The present invention relates to a method and article for protecting human hands from the transfer of infectious germs and diseases by providing a film such as a sheet, partial mitten or a partial glove covering with having a adhesive on one side for attachment to a user's hand, the film being preferably dispensed from an elongated film strip stored, for example, on a roll. Even more particularly, the present invention relates to a method and article for providing a sanitary barrier for a human hand that is dispensed from a roll and wherein sequential segments of film material are removed from the roll when a user placing his or her hand against a strip of film material that is at the free end of the roll so that an adhesive or sticky surface of the film causes the film to stick to the user's hand. The mild adhesive at interface of the hand and the film overcomes a tensile capability of the film at a serration so that when the user presses his or her hand against the film and pulls away, the film tears at the serration leaving a segment of the film attached to the user's hand to form a sanitary barrier.

2. General Background of the Invention

The news media often details accounts of the spread of communicable diseases that range from the common cold to hepatitis resulting from poor hygiene practices. Current data suggests that only one-third of the general population wash their hands after using the rest room. It is virtually impossible to properly wash hands after covering ones' mouth during a sneeze. Food workers and handlers, such as wait staff come in contact with contaminated objects and uncooked food and then may serve cooked food with no convenient opportunity to wash hands. These are just a few scenarios of everyday situations of thousands of people we come into contact with.

The spread of colds, viruses and the like is a problem when a contaminated person serves themself at a self-serve salad bar, or food bar, without first properly washing their hands. The uncontaminated person can have diseases spread to themselves by using the same contaminated utensil previously used, thereby spreading the pathogen from that serving utensil to their own hands. After a contamination conscious person does properly wash their hands they may have to pull down an infected towel lever or open a door using an infected door handle, thus defeating their purpose. Use of the present invention precludes this problem.

The only effective known approaches to the above spread of infection problems have been proper hand washing using hot water and soap. Compliance and proper technique is known to be less than ideal thereby putting healthy people at risk of those who do not utilize good hygiene. Even with good hand washing techniques, the clean hands of a person is contaminated when they have to touch a contaminated object, make change after handling food, etc. Disposable sanitary gloves, while providing protection if used properly, are easily contaminated in the process of donning the gloves. Likewise, the need for use of the sanitary gloves is frequently interrupted by a contaminated process, such as taking money, requiring the removal of the gloves and then donning of a fresh pair, a cumbersome and costly process.

BRIEF SUMMARY OF THE INVENTION

The apparatus of the present invention solves these common spread of infection problems confronted in the art in a simple and straightforward manner. The present invention provides a sanitary hand barrier that can be easily dispensed, utilized, and removed. Gloves are usually too cumbersome to put on and remove. Because of the inconvenience, patrons at a salad bar, self-serve food bar, or rest room would more than likely than not use gloves even though they are fully aware of the potential for spread of disease.

The characteristics of this invention will utilize a roll of film or tape with the consistency of a "thick" saran wrap that has been coated with a mild adhesive that also has the property of being non allergenic. The adhesive can be analogous in aggressiveness to the adhesive found on Post-it® notes, i.e., with just enough adherence to cause the film to adhere to the skin and thereby provide a barrier from the aforementioned contaminates, and then be easily removed and disposed of.

The advantages of this invention include its ease of use which will encourage compliance, and thereby helping eliminate the increasing incident rates of hepatitis, colds, influenza and the like.

The barrier tape article of the present invention will be held in a dispenser that will allow the user to place a selected hand onto the free end of the film roll or tape, slide down, and tear at the perforation, setting up the next film barrier segment into place for the next user. The dispenser shall have the capabilities to be easily placed at the front of the dispensing region, as at the salad or food bar, work stations or counters, or rest rooms and be easily loaded the rolls of film, as from the side, and which can be locked to prevent any tampering.

The present invention can be used where ever one is concerned with good hygiene. Some areas of use include self-serve salad or food bars, cafeterias, fast food restaurants where a worker prepares or serves food and works with a cash register, grocery stores and like food markets, for example, wherein patrons have to handle certain food items such as chicken or fish without getting liquid that may be contaminated on their hands. Other areas of use include self-service food dispensing counters such as those wherein a patron is dispensed donuts, bagels, rolls or the like.

The method and apparatus of the present invention also have utility in rest rooms for persons that have already washed their hands and want to be free of contamination when pushing down a towel dispenser handle, or opening a door without picking up germs or microorganisms that could cause infection of disease The present invention also has utility in areas where a barrier is desired against dirty, oily or staining items such as at service stations, manufacturing facilities, auto repair shops and the like.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 2 is a perspective view of the preferred embodiment of the apparatus of the present invention showing the dispensing of a free end segment from a roll;

FIG. 3 is a perspective view of the preferred embodiment of the apparatus of the present invention showing the removal of a free end segment from a roll; and FIG. 4 is a perspective view of the preferred embodiment of the apparatus of the present invention.

DETAILED DESCRIPTION OF THE INVENTION

Figure 1:
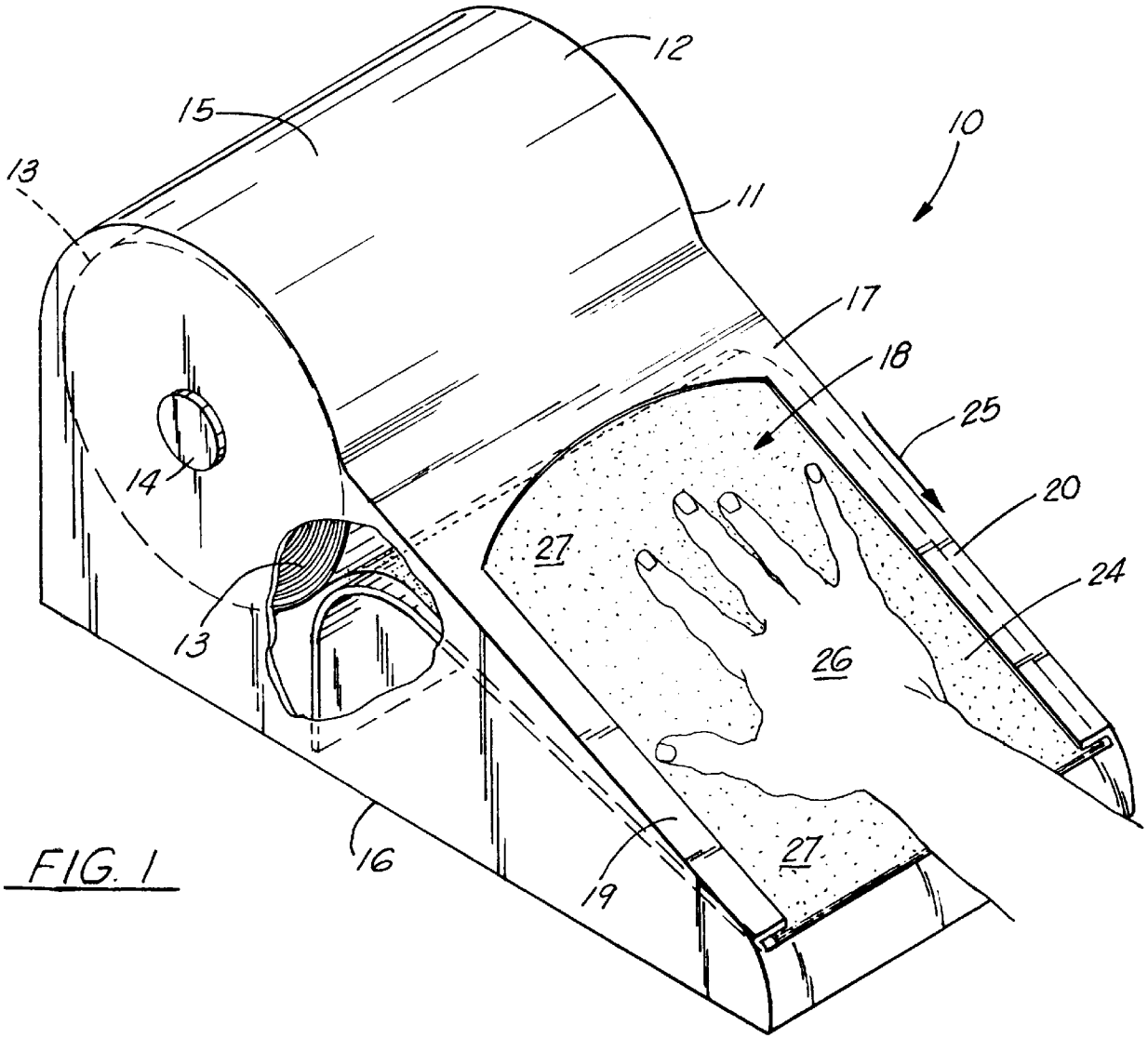
FIG. 1 is a perspective view of the preferred embodiment of the apparatus of the present invention.

FIGS. 1–3 show a preferred embodiment of the apparatus of the present invention designated generally by the numeral 10 in FIGS. 1–3. The sanitary hand barrier apparatus 10 of the present invention includes a dispenser 11 having a lower surface 16 that can be generally flat for placement upon a surface such as a table, an enlarged end portion 12 that is cylindrically shaped to accommodate a supply roll 13 (partially shown) of barrier material and a smaller end portion that carries a window 18 for displaying a segment of film to be removed. Backing plate 30 is positioned behind and supports film web 23 at window 18 to back up the film web 23 when a user's hand 26 contacts the film web 23 at window 18, facilitating the orientation of film web 23 on dispenser 10. Those skilled in the art will understand that, depending upon the degree of adhesion on film web 23, the underside of rails 19, 20 may be advantageously coated with a non-stick surface to allow unimpeded advance of the web 23.

The dispenser 11 provides a cylindrically shaped receptacle portion 15 that carries roll 13 upon shaft 14. This enables the roll 13 to rotate and pay out the free end portion 24 of the film web 23 to an open window 18 portion of the dispenser 11.

The dispenser 11 has an upper inclined surface 17 that carries window 18 for displaying a segment of film that will be removed by a user's hand designated as 26 in FIGS. 1–4. The window can be framed by a pair of spaced apart rails 19, 20, that guide the free end portion 24 of the film web 23 toward the user in the direction of arrows 25 as shown in FIGS. 1–3. These rails 19, 20 simply overlap the left and right side portions of the film web 23 at its free end portion 24.

In FIG. 1, the free end portion 24 of the web 23 provides a segment 28 to be removed from the remaining web 23 at serration 21. In FIG. 3, a cutting blade 22 is illustrated which can be used to facilitate severing the segment 28 to be removed from the remainder of the film web 23. Cutting blade 22 may be similar to the serrated edge of tape or plastic film dispensers know in the art.

In FIGS. 1–4, the film web 23 provides an upper adhesive surface 27 that faces the user so that when the user places a hand 26 on the free end portion 24 of the film web 23 that is framed by window 18, the user's hand 26 sticks to the adhesive surface 27. In FIG. 2, the adhesion is strong enough to sever the serration 22 once the user has pulled the free end portion 24 of web 23 in the direction of arrow 25 until the serration 21 is at the lower end 29 of the rails 19 and 20. In FIG. 3, the user advances the free end 24 of the web 23 sufficiently to provide a segment 28 to be removed that will fit the user's hand 26, as shown in FIG. 3. In such a situation, the user simply grabs the segment 28 to be removed with the hand 26, the adhesive causing the segment 28 to be removed to stick to the hand 26. The user then tears the segment 28 from the remaining film web 23 using the cutting blade 22, as by a downward or sideward, tearing stroke.

In FIG. 4, as with either of the cutting versions shown in FIGS. 2 and 3, a removed segment 28 is shown that adheres to a user's hand because of the adhesive surface 27. The adhesive surface 27 is aggressive enough to cause the removed segment 28 to stick to the user's hand 26, but not so aggressive that the user cannot easily remove the segment 28 from the hand 26 after use and when the user decides to discard the segment 28.

Figure 5:
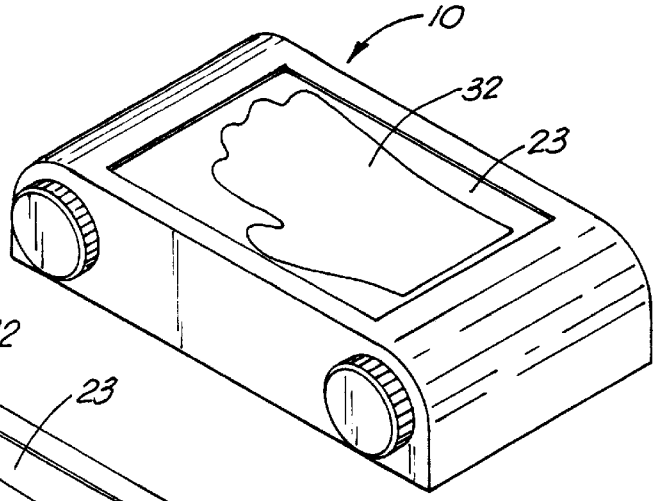
FIG. 5 is a perspective view of an alternative embodiment of apparatus of the present invention showing apparatus for dispensing a shaped film segment from a roll, wherein the dispenser includes a take-up reel for any remainder film.
Figure 6:
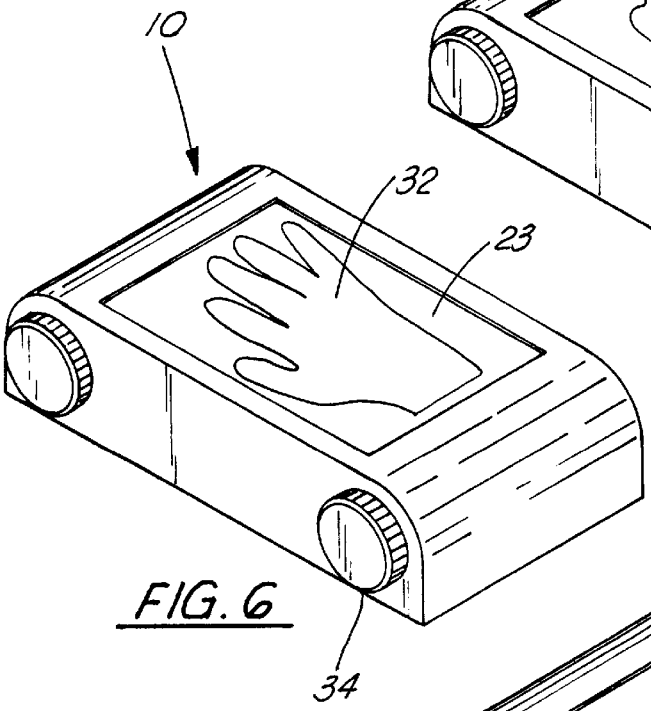
FIG. 6 is a perspective view of an alternative embodiment of apparatus of the present invention illustrating a shaped segment of film in the form of a hand.
Figure 7:
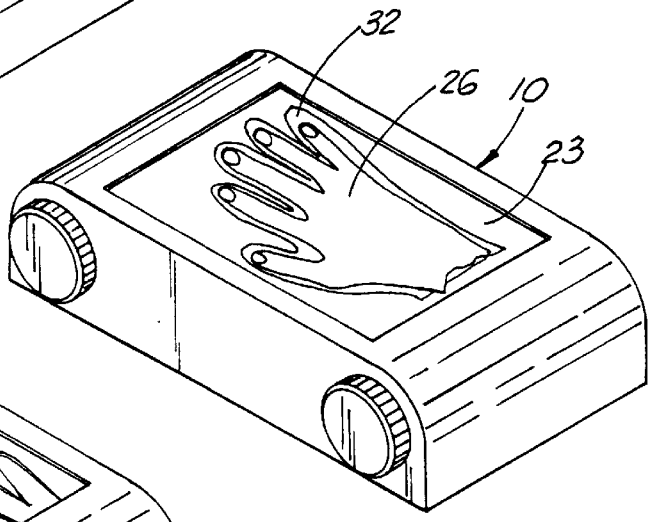
FIG. 7 is a perspective view of an alternative embodiment of apparatus of the present invention illustrating the placing of the hand over the shaped film segment.
Figure 8:
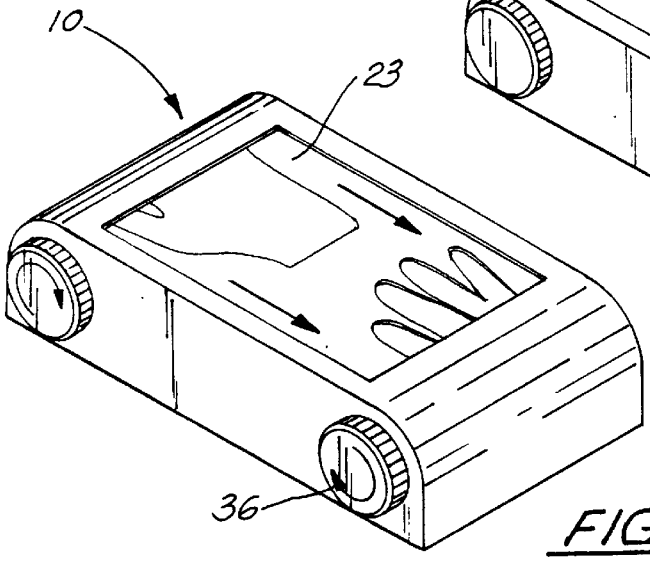
FIG. 8 is a perspective view of an alternative embodiment of apparatus of the present invention illustrating the sequencing of the film to present a next shaped film segment.

FIGS. 5 through 8 illustrate alternative embodiments of sanitary hand barrier apparatus 10 wherein the film web 23 may include a shaped barrier 32, as in the form similar to a mitten as illustrated in FIG. 5 or one resembling one side of a glove, as illustrated in FIG. 6. While the detachable segment 28 illustrated in FIGS. 1 through 4 is quite effective in isolating the hand from contamination, convenience, manipulation or acceptability of appearance may demand a barrier form more closely approximating the human hand. To accommodate such needs, the shaped barrier 32 is formed in film web 23 with a serration forming an outline of the preferred shape (e.g., mitten or glove). As with the previously described dispensing, the user's hand 26 is placed on the shaped barrier 32, and the adhesive provides sufficient adherence to overcome the resistance of separating the shaped barrier 32 from the film web 23.

As is further illustrated in FIGS. 5 through 8, when a shaped barrier 32 is preferred over a sheet 28, the barrier 32 is separated from the outer perimeter of film web 23, leaving a the remaining film web 23. Dispenser 11 in these figures includes a take up reel 34 which is preferably rotated in general synchronism with dispensing roll 13 providing a take up of the remainder of film web 23 and alleviating any undesirable accumulation thereof The arrangement of such synchronized rolls is considered within the skill of the art as similar to the familiar cloth towel dispensers and the like. Such devices may be operated as by turning knobs 36, or by tension or energy operated mechanisms as springs or electrically powered motors, actuated by a touch control.

The following table lists the parts numbers and parts descriptions as used herein and in the drawings attached hereto.

PARTS LIST

PARTS LIST

| Part Number | Description |
|---|---|
| 10 | sanitary hand barrier apparatus |
| 11 | dispenser |
| 12 | enlarged end |
| 13 | roll |
| 14 | shaft |
| 15 | cylindrically shaped receptacle |
| 16 | lower surface |
| 17 | inclined upper surface |
| 18 | window |
| 19 | rail |
| 20 | rail |
| 21 | serration |

-continued

PARTS LIST

| Part Number | Description |
|---|---|
| 22 | cutting blade |
| 23 | film web |
| 24 | free end portion |
| 25 | arrow |
| 26 | user's hand |
| 27 | adhesive surface |
| 28 | removed segment |
| 29 | lower end |
| 30 | backing plate |
| 32 | shaped barrier |
| 34 | take-up reel |
| 36 | knob |

The foregoing embodiments are presented by way of example only; the scope of the present invention is to be limited only by the following claims.

I claim:

1. A method of providing a sanitary barrier for a user's hand comprising the steps of:

a) providing a supply of segments of polymeric film on an elongated roll, each having a surface that enables the segment to adhere to a user's hand when the user places his or her hand against the surface;

b) separating one segment from the next segment with a serration; and c) wherein the film tears at the serration when the user withdraws his or her hand away from the area occupied by the supply roll so that the adhesion between the film and user's hand is able to overcome the tensile strength of the roll at the serration.

2. An apparatus for dispensing and installing a sanitary barrier on the palm of a user's hand:

a) a dispenser having a window;

b) a roll of film stored on the dispenser with a free end positioned at the window;

c) the roll having a plurality of segments, each segment having an adhesive surface that enables that segment to stick to the palm of a user's hand when the user applies pressure to the segment; and d) means for forming serrations between segments;

e) wherein the adhesive surface sticks to the user's hand with sufficient adhesion so that the tensile strength of the roll at the serration next to the segment is overcome when the user withdraws his or her hand from the area next to the roll.

3. The apparatus of claim 2 wherein the dispenser has a backing plate that holds the free end portion of the film at the window.

4. The apparatus of claim 3 wherein the dispenser has a frame with a flat surface that defines a backing plate for each successive segment to be dispensed so that a user places his or her hand against the film segment backed by the backing plate.

5. The apparatus of claim 4 wherein the dispenser has a bar that extends across the backing plate, and wherein the film roll passes in between the bar and the backing plate.

6. The apparatus of claim 2 wherein said serration forming means is a cutting blade.

7. The apparatus of claim 2 wherein said serration forming means includes tearable serrated portions of the film spaced at intervals forming segments along the film web.

8. An apparatus for dispensing and installing a sanitary barrier on the palm of a user's hand:

a) a dispenser having a window;

b) a roll of film stored on the dispenser with a free end positioned at the window;

c) the roll having a plurality of segments, each segment having an adhesive surface that enables that segment to stick to the palm of a user's hand when the user applies pressure to the segment; and d) said segment including a releaseable shaped portion outlined by tearable serrations;

e) wherein the adhesive surface sticks to the user's hand with sufficient adhesion so that the tensile strength of the film at the serration next to the segment is overcome when the user withdraws his or her hand from the area next to the roll and said shaped portion remains on the palm and is detached from said film.

9. The apparatus of claim 8 including a take-up roll disposed in said apparatus opposite said window of said roll of film whereby upon rotating said take-up roll said segments of said film remaining after separation of said shaped portion may be stored within said apparatus.

10. The apparatus of claim 9 wherein said take-up roll is rotatably driven by the film roll as the film is advanced through said window.

11. The apparatus of claim 8 wherein said shaped portion is shaped in the image of a mitten having an extended thumb portion.

12. The apparatus of claim 8 wherein said shaped portion is shaped in the image of a glove having extended finger and a thumb portions.

* * * * *